US011751637B1

(12) United States Patent
Riera

(10) Patent No.: US 11,751,637 B1
(45) **Date of Patent: *Sep. 12, 2023**

(54) ROOFING TRACTION SHOE CHASSIS AND METHOD OF DONNING SAID CHASSIS TO A SHOE

(71) Applicant: Davin Riera, Concord, NC (US)

(72) Inventor: Davin Riera, Concord, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/734,343

(22) Filed: May 2, 2022

Related U.S. Application Data

(63) Continuation of application No. 17/120,960, filed on Dec. 14, 2020, now Pat. No. 11,317,680.

(60) Provisional application No. 62/947,566, filed on Dec. 13, 2019.

(51) Int. Cl.
*A43C 15/06* (2006.01)
*A43C 15/00* (2006.01)
*A43B 13/36* (2006.01)

(52) U.S. Cl.
CPC ..... *A43C 15/00* (2013.01); *A43B 13/36* (2013.01); *A43C 15/068* (2013.01)

(58) Field of Classification Search
CPC ..... A43C 15/00; A43C 15/02; A43C 15/068; A43C 15/09; A43C 15/06; A43C 5/18; A43C 13/36; A43C 3/16; A43B 5/18; A43B 13/36; A43B 3/16
See application file for complete search history.

(56) References Cited

U.S. PATENT DOCUMENTS 1,837,730 A * 12/1931 Smith ..... A43C 15/06 36/7.6
2,588,919 A * 3/1952 Gredell ..... A43C 15/063 36/7.7
2,813,356 A * 11/1957 Webb ..... A43C 15/06 36/7.6
2,932,910 A 4/1960 Brown
3,699,672 A 10/1972 Sims
3,733,721 A 5/1973 Clemens
4,344,238 A * 8/1982 Peyser ..... A43C 15/068 36/62
4,897,935 A 2/1990 Fel
5,259,125 A 11/1993 Gromes
5,727,334 A * 3/1998 Cougar ..... A43B 13/36 36/15
5,836,090 A 11/1998 Smith
(Continued)

*Primary Examiner* — Ted Kavanaugh
(74) *Attorney, Agent, or Firm* — Invention To Patent Services; Alex Hobson

(57) ABSTRACT

A roofing shoe traction chassis system has a roofing shoe traction chassis with a toe strap, foot strap and heel strap coupled thereto for securing a shoe to the chassis. The chassis also has a detachable traction sheet configured for attachment to the base of the roofing shoe chassis. The roofing shoe traction chassis can be quickly donned over a pair of shoes allowing a user to wear a more comfortable and better ventilated shoe. The detachable traction sheet can be changed out as the traction layer is worn. An exemplary roofing shoe traction chassis has a strap support that extends up from a support plate and has a toe strap and foot strap aperture to receive and retain the toe and heel straps respectively. The support plate may also have post apertures for receiving and retaining heel strap posts.

20 Claims, 8 Drawing Sheets

(56) References Cited

U.S. PATENT DOCUMENTS

| | | | | |
|---|---|---|---|---|
| 5,996,252 | A * | 12/1999 | Cougar | A43B 13/36 36/15 |
| 7,377,054 | B2 | 5/2008 | Milner et al. | |
| 11,317,680 | B1 * | 5/2022 | Riera | A43C 15/068 |
| 2003/0106241 | A1 | 6/2003 | Marden et al. | |
| 2003/0230007 | A1 * | 12/2003 | Walton | A43B 13/36 36/15 |
| 2008/0216356 | A1 | 9/2008 | Croucher | |
| 2010/0257750 | A1 * | 10/2010 | Bell | A43C 15/02 36/7.6 |

* cited by examiner

ROOFING TRACTION SHOE CHASSIS AND METHOD OF DONNING SAID CHASSIS TO A SHOE

CROSS REFERENCE TO RELATED APPLICATIONS

This application is a continuation of U.S. patent application Ser. No. 17/120,960, filed on Dec. 14, 20220 and currently pending, which claims the benefit of U.S. provisional patent application No. 62/947,566, filed on Dec. 13, 2019; the entirety of which is hereby incorporated by reference herein.

BACKGROUND OF THE INVENTION

Field of the Invention

The invention relates to a roofing shoe traction chassis system comprising a roofing shoe traction chassis having a toe and heel strap for detachable attachment of a shoe and a traction sheet that is detachably attachable to the traction surface, or base of the roofing shoe traction chassis.

Background

Roofing is a dangerous job due to the high elevation and chance of falling from the roof. It is recommended to where shoes with good traction and some shoes specifically designed for roofing have a traction material on the sole of the shoe. These shoes come in limited styles, typically boots which can be very hot and heavy. Home and roofing inspectors, insurance adjusters and others that have to go onto and off of various roofs throughout the day often take off these hot and heavy roofing shoes between jobs which takes a lot of time out of their busy day.

SUMMARY OF THE INVENTION

The invention is directed to a roofing shoe traction chassis system comprising a roofing shoe traction chassis having a toe strap, foot strap and heel strap for coupling to a shoe and a detachable traction sheet configured for attachment to the base of the roofing shoe chassis. The roofing shoe traction chassis can be quickly donned over a pair of shoes allowing a user to wear a more comfortable and better ventilated shoe. The detachable traction sheet can be changed out as the traction layer is worn. An exemplary roofing shoe traction chassis has a strap support that extends up from a support plate and has a toe strap and foot strap aperture to receive and retain the toe and heel straps respectively. The support plate may also have post apertures for receiving and retaining heel strap posts.

An exemplary toe strap is configured to extend through the toe strap aperture of the strap support to secure a toe of said shoe to the roofing shoe traction chassis. An exemplary toe strap has a loose end that can be pulled through the aperture in the strap support and configured back over the toe strap or a foot pad and secured by hook-and-loop fastener. Likewise, an exemplary foot strap is configured to extend through the foot strap aperture of the strap support to secure the upper portion of said shoe to the roofing shoe traction chassis. An exemplary foot strap has a loose end that can be pulled through the foot strap aperture in the strap support and configured back over the foot strap or a foot pad and secured by hook-and-loop fastener. This enables adjustment over an assortment of shoe sizes. One component of the hook-and-loop fastener, such as the loop portion, may be configured on the loose end of the toe strap and the mating component, the hook portion, may be configured on a foot pad and/or along a portion of the strap that extends over the shoe. In an exemplary embodiment, a roofing shoe traction chassis comprises an inside and an outside strap support and the toe and foot straps extend between the inside and outside supports.

An exemplary heel strap is configured to extend from the chassis around a heel of a shoe. An exemplary heel strap may be couple to the chassis by a heel strap post that is configured in one of a plurality of post aperture. The plurality of post aperture may extend along in a row along the length of the strap support or from a position proximal to the heel end toward the toe end of the support plate or strap support. A user may select an appropriate post aperture for the size of their shoe. An exemplary heel strap comprises a heel strap post on the loose end of the heel strap and this post is configured for insertion in to one of a plurality of post apertures in the strap support. An exemplary heel strap or portion thereof may be elastic to provide secure positioning around the heel of the shoe. An exemplary heel strap may comprise a ratchet mechanism that can be used to index ratchet teeth inserted into the ratchet. A heel strap may have a first portion that has a ratchet mechanism proximal an extended end and a second heel strap portion that is configured to be inserted into the ratchet and comprises ratchet teeth.

An exemplary roofing shoe traction chassis comprises a detachable traction sheet that is configured to be coupled to the traction surface of the roofing shoe traction chassis. A base hook-and-loop fastener is configured on the traction surface or base of the roofing shoe traction chassis and a corresponding hook-and-loop fastener layer of the detachable traction sheet enables detachable attachment. The detachable traction sheet has a traction layer that faces away from the roofing shoe traction chassis when attached. This detachable traction sheet provides high friction and traction on a wide variety of roofing surface and may comprise a fibrous material.

A detachable traction sheet and in particular the traction layer, has a coefficient of friction as measured by ASTM D1894-14 of about 0.5 or more, and preferably 0.75 or more, and even more preferably 1.0 or more, such as 1.25 or even 1.5 or more. ASTM D1894-14 is the most widely used method for COF measurement. This method involves measuring a sheet or layer of material with a fixed weight on top. The sample is dragged along a stainless steel sheet under dry or wet conditions and friction force is thus measured by a forcemeter. The normal force in this test is equal to the gravity force of the weight.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
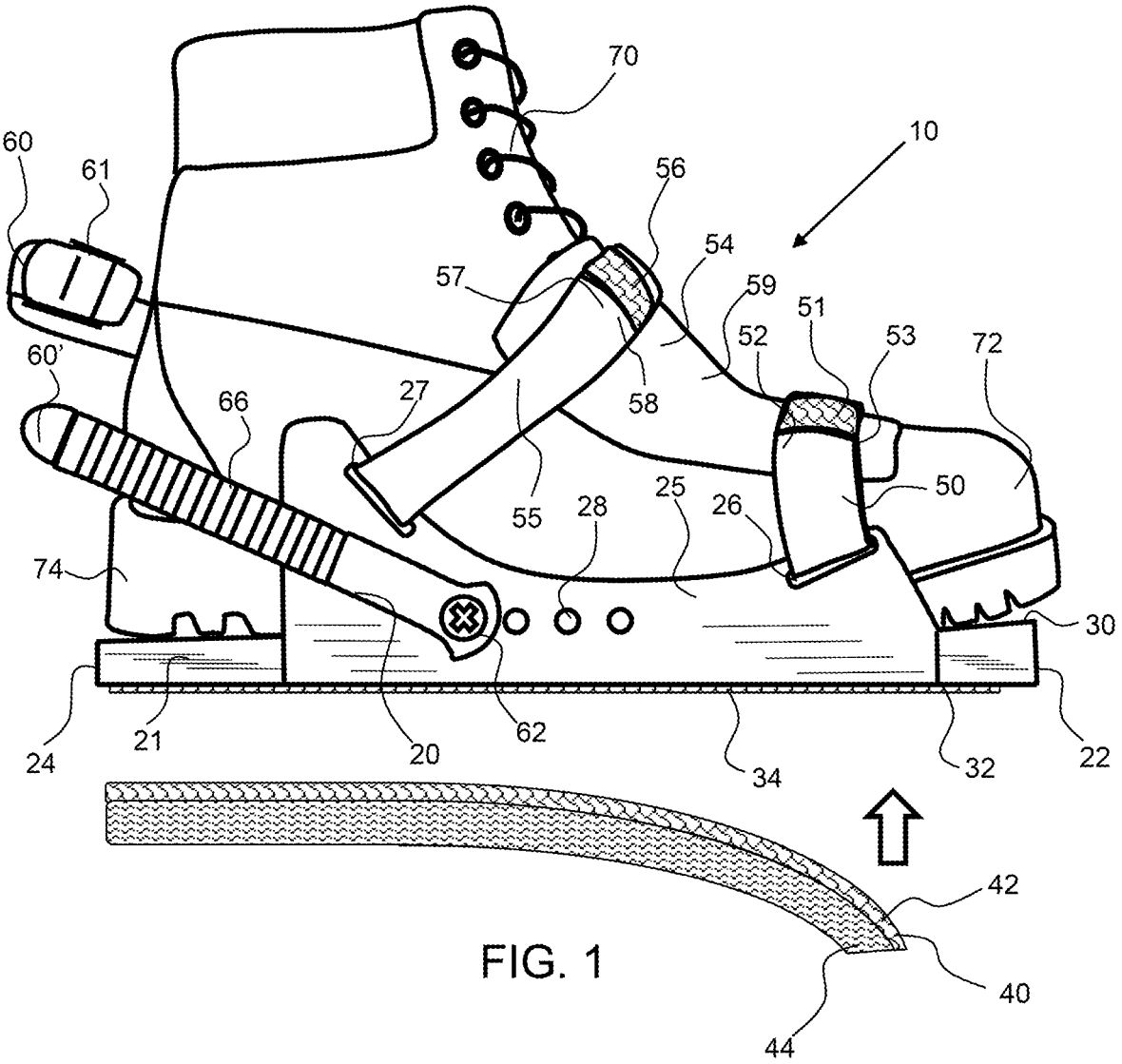
FIG. 1 shows a side view of an exemplary roofing shoe traction chassis system comprising a roofing shoe traction chassis detachably attached to a shoe by a toe strap, a foot strap and a heel strap and having a detachable traction sheet detached.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

Elastic, as defined herein, is a material that can be elongated by a force and then return to an original length upon removal of the force.

High friction, as defined herein, is a material with a coefficient of friction of at least 0.5, as determined by ASTM D1894-14 under dry conditions, and preferably at least 0.75.

Hook-and-loop, as used herein, utilizes two components attached to the opposing surfaces to be fastened. The first component has tiny hooks and the second component has smaller loops. When pressed together the hooks catch in the loops and the two pieces fasten or bind temporarily.

Figure 2:
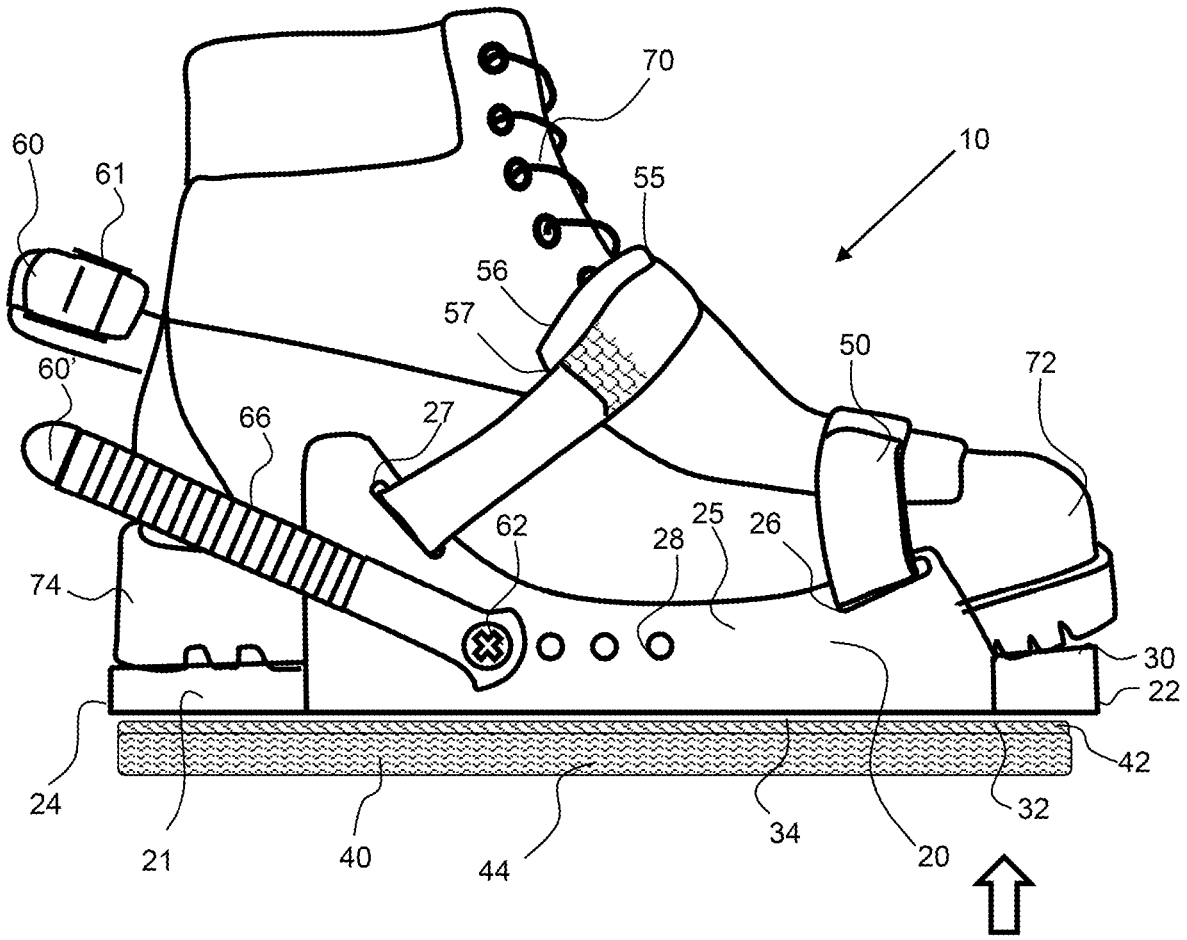
FIG. 2 shows a side view of an exemplary roofing shoe traction chassis system comprising a roofing shoe traction chassis detachably attached to a shoe by a toe strap, a foot strap and a heel strap and having a detachable traction sheet attached to the base hook-and-loop fastener on the traction surface of the roofing shoe traction chassis.
Figure 3:
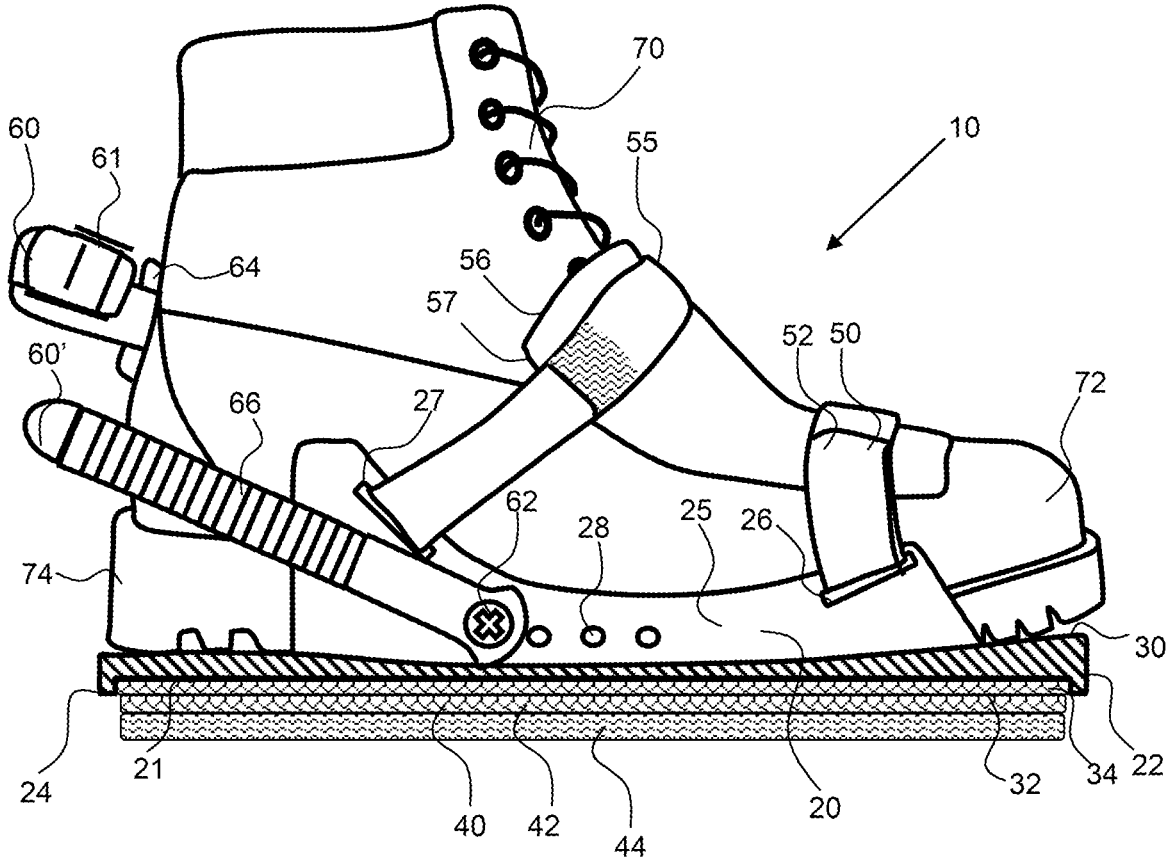
FIG. 3 shows a side view of an exemplary roofing shoe traction chassis detachably attached to a shoe and a cross-sectional view of the support plate to show the base hook-and-loop fastener on the traction surface of the support plate and the detachable traction sheet attached thereto.

Referring now to FIGS. 1 to 3, an exemplary roofing shoe traction chassis system 10 comprises a roofing shoe traction chassis 20 detachably attached to a shoe 70 by a toe strap 50, a foot strap 55, and a heel strap 55. A strap support 25 extends up from the support plate 21 and has a toe strap aperture 26 and a foot strap aperture 27 to enable a person to pull the toe and foot straps through the respective strap aperture and back over the shoe to tighten the loose ends with a hook-and-loop fastener back onto the toe strap. The loose end 52 of the toe strap 50 comprises loose end hook-and-loop fastener 53 that is coupled to the strap hook-and-loop fastener 51 and the loose end 57 of the foot strap 55 comprises loose end hook-and-loop fastener 58 that is coupled to the strap hook-and-loop fastener 56 of the foot strap 55. Again, the foot pad may comprise pad hook-and-loop fastener 59 and the toe and foot straps may be coupled directly to the foot pad.

The strap support 25 also has post apertures 28 to couple the heel strap 60 thereto. The plurality of post apertures extend along the length of the roofing shoe traction chassis in a consecutive manner to allow selection of a desired post aperture for a secure fit. The heel strap or a portion thereof may be an elastic material to further provides a secure and tight fit around the heel of the shoe. As shown, the heel strap comprises a first strap portion 60 having ratchet teeth and on the extended end of a second heel strap portion 60', a ratchet 61 is configured to receive the first heel strap portion and tighten the strap around the heel of the shoe 74. A heel pad 64 may be coupled to the heel strap to provide support around the heel of the shoe.

A shoe 70 is inserted onto the sole surface 30 of the support plate 21 and the two straps are pulled tight and retained to secure the shoe to the roofing shoe traction chassis. The roofing shoe traction chassis has a length from a toe end 22 to a heel end 24. A base hook-and-loop fastener 34 is configured on the traction surface 32 of the support plate and is configured for detachable attachment of a detachable traction sheet 40. The detachable traction sheet has a hook-and-loop fastener configured for attachment to the traction surface and a traction layer 44, configured to provide good traction on a roofing surface. As shown in FIG. 1, the detachable traction sheet is detached and as shown in FIGS. 2 and 3, the detachable traction sheet is attached to the roofing shoe traction chassis. FIG. 3 shows a cross-sectional view of the support plate 21 to show the base hook-and-loop fastener 34 on the traction surface 32 of the support plate and the detachable traction sheet 40 attached thereto by the hook-and-loop fastener 42 on the traction sheet.

Figure 4:
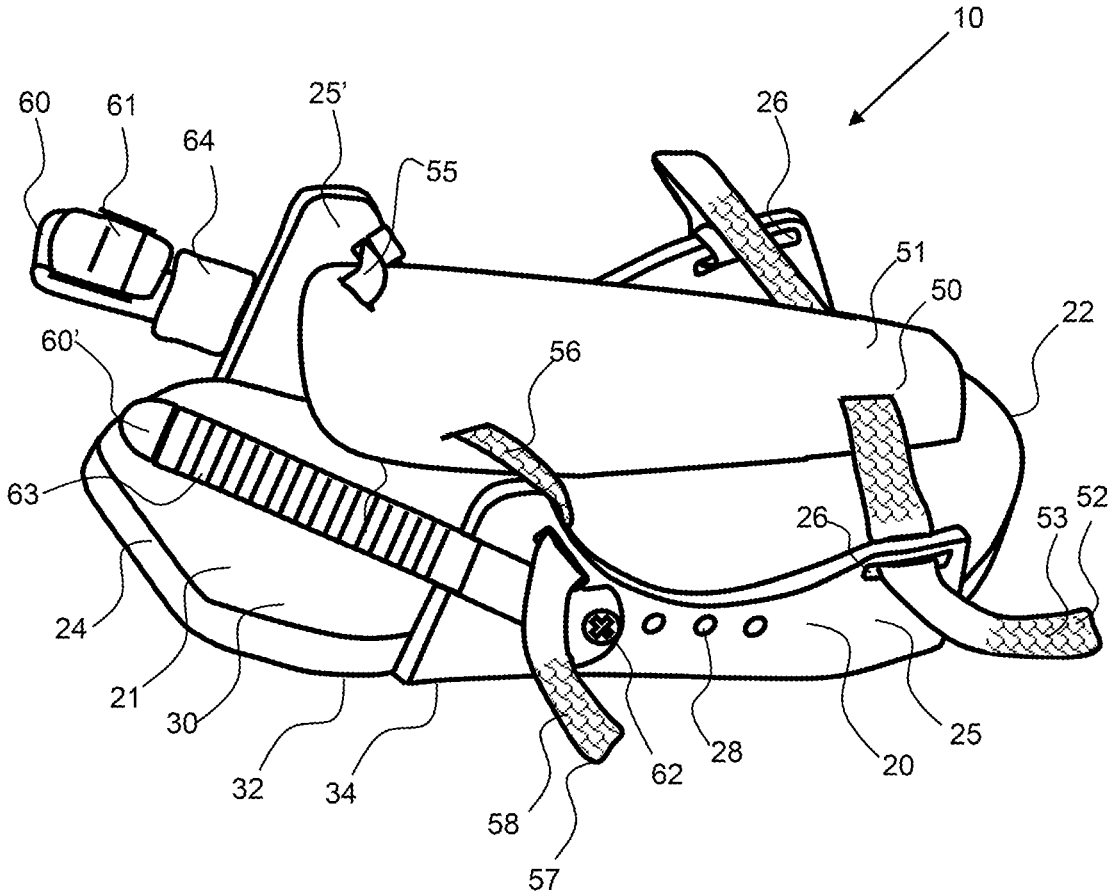
FIG. 4 shows a side view of an exemplary roofing shoe traction chassis having a toe strap and a foot strap with hook-and-loop fastener for adjustment over the toe and upper foot portion of a shoe and a heel strap having a heel strap post for insertion into one of the post apertures in the strap support, to adjust the heel strap around the heel of a shoe.

A shown in FIG. 4, an exemplary roofing shoe traction chassis 20 has a toe strap 50 with a loose-end hook-and-loop fastener 53 configured on the loose end 52 of the toe strap for attachment to the strap hook-and-loop fastener 51. Likewise, a foot strap 55 is configured with loose end hook-and-look fastener 58 on the loose end 57 of the foot strap for attachment to the foot strap hook-and-loop fastener 56. The toe strap 50 is configured through the toe strap aperture 26 in the strap support 25 and the foot strap 55 is configured through the foot strap aperture 27 in the strap support 25. The roofing shoe traction chassis 20 has an inside strap support 25 and an outside strap support 25'. The toe and heel straps may be coupled to one of the strap apertures on one of the strap supports, leaving just one extended loose end for pulling back over the shoe and coupling to secure the shoe to the chassis. The heel strap 60 has a first heel strap portion 60 and a second heel strap portion 60'. A ratchet 61 is configured on the loose end of the first heel strap portion 60 and is configure to receive the loose end of the second heel strap portion 60', which has ratchet teeth 63 to enable tightening with the ratchet. The heel strap portions may be detachably attached to the post aperture 28 in the strap supports 25, 25'. The plurality of post apertures enable locating and attaching the heel straps to provide a good and secure fit around the heel of a shoe.

Figure 5:
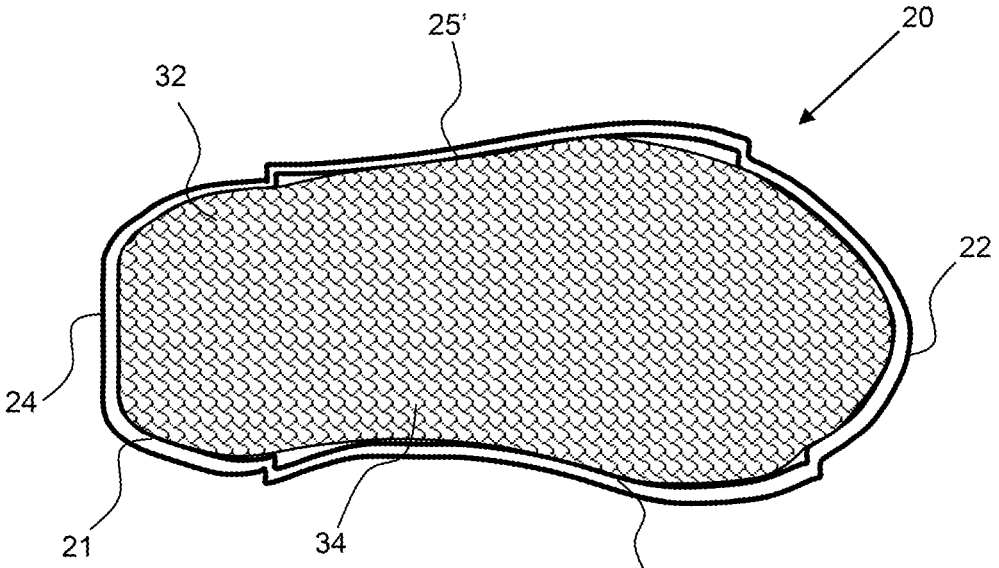
FIG. 5 shows a bottom view of an exemplary roofing shoe traction chassis having a traction surface configured with a base hook-and-loop fastener configured thereon.

As shown in FIG. 5, an exemplary roofing shoe traction chassis 20 has a traction surface 32 configured with a base hook-and-loop fastener 34. This base hook-and-loop fastener enables detachable attachment of the traction sheet (not shown).

Figure 6:
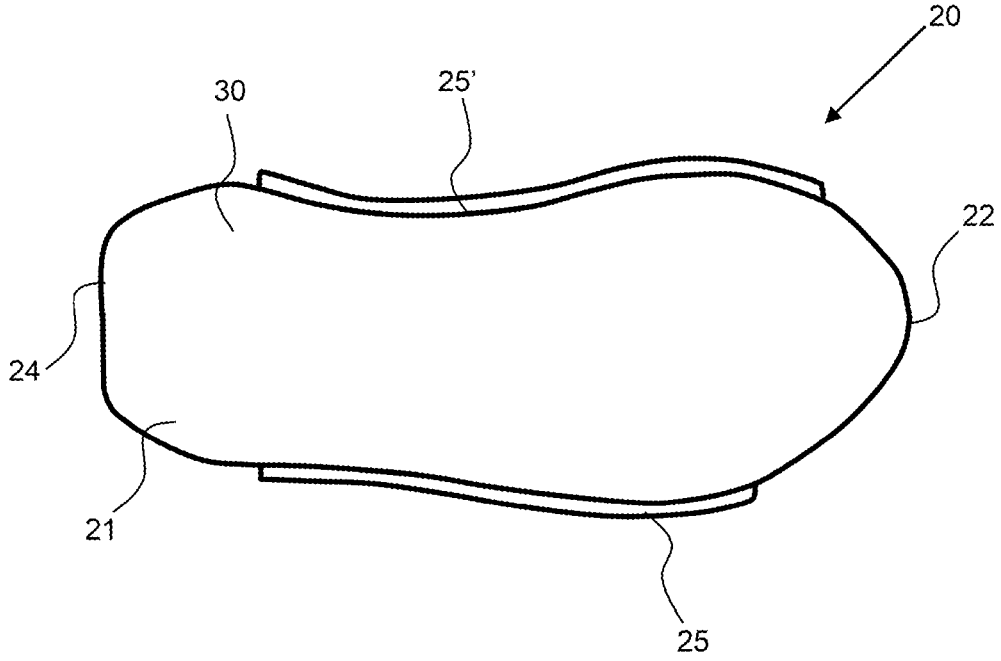
FIG. 6 shows a top view of an exemplary roofing shoe traction chassis having a sole surface and strap supports extending up from the support plate on the inside and outside of the roofing shoe traction chassis.

As shown in FIG. 6, an exemplary roofing shoe traction chassis 20 has a sole surface 30 and strap supports 25, 25' extending up from the support plate 21 on the inside and outside of the roofing shoe traction chassis.

Figure 7:
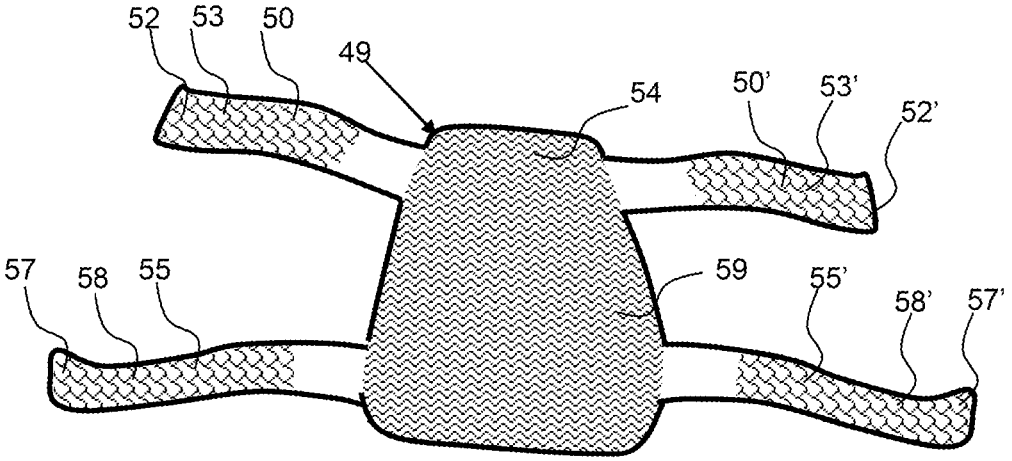
FIG. 7 shows a top view a foot pad assembly having a toe strap and a foot strap extending from the foot pad portion of the foot pad assembly.
Figure 8:
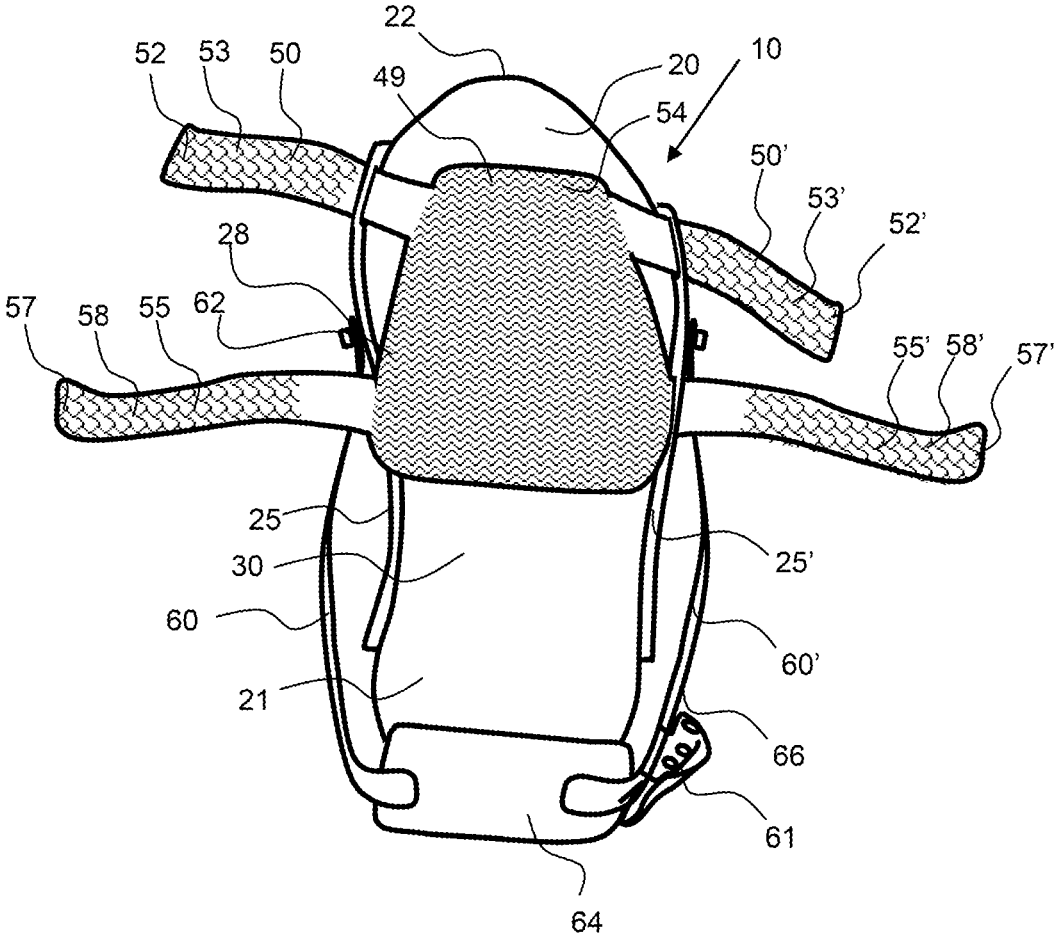
FIG. 8 shows a top view of an exemplary roofing shoe traction chassis system comprising the foot pad assembly shown in FIG. 7 with the toe and foot straps extending through the toe and foot strap apertures of the strap supports and the heel strap coupled to the post apertures in the strap supports extending up from the support plate.

Referring now to FIGS. 7 and 8, a foot pad assembly 49 comprises a foot pad 54 and a toe strap 50 and foot strap 55 extending therefrom. The foot pad may comprise pad hook-and-loop fastener 59 to allow the straps to be quickly secured to the foot pad. Each of the toe and foot straps has at least one loose end having loose end hook-and-loop fastener material thereon. As shown in FIG. 8, the loose ends 52, 52' of the toe strap 50 and loose ends 57, 57' of the foot strap 55 extend through the toe strap apertures 26, 26' and foot strap apertures 27, 27' of the inside strap support 25 and outside strap support 25' respectively.

Figure 9:
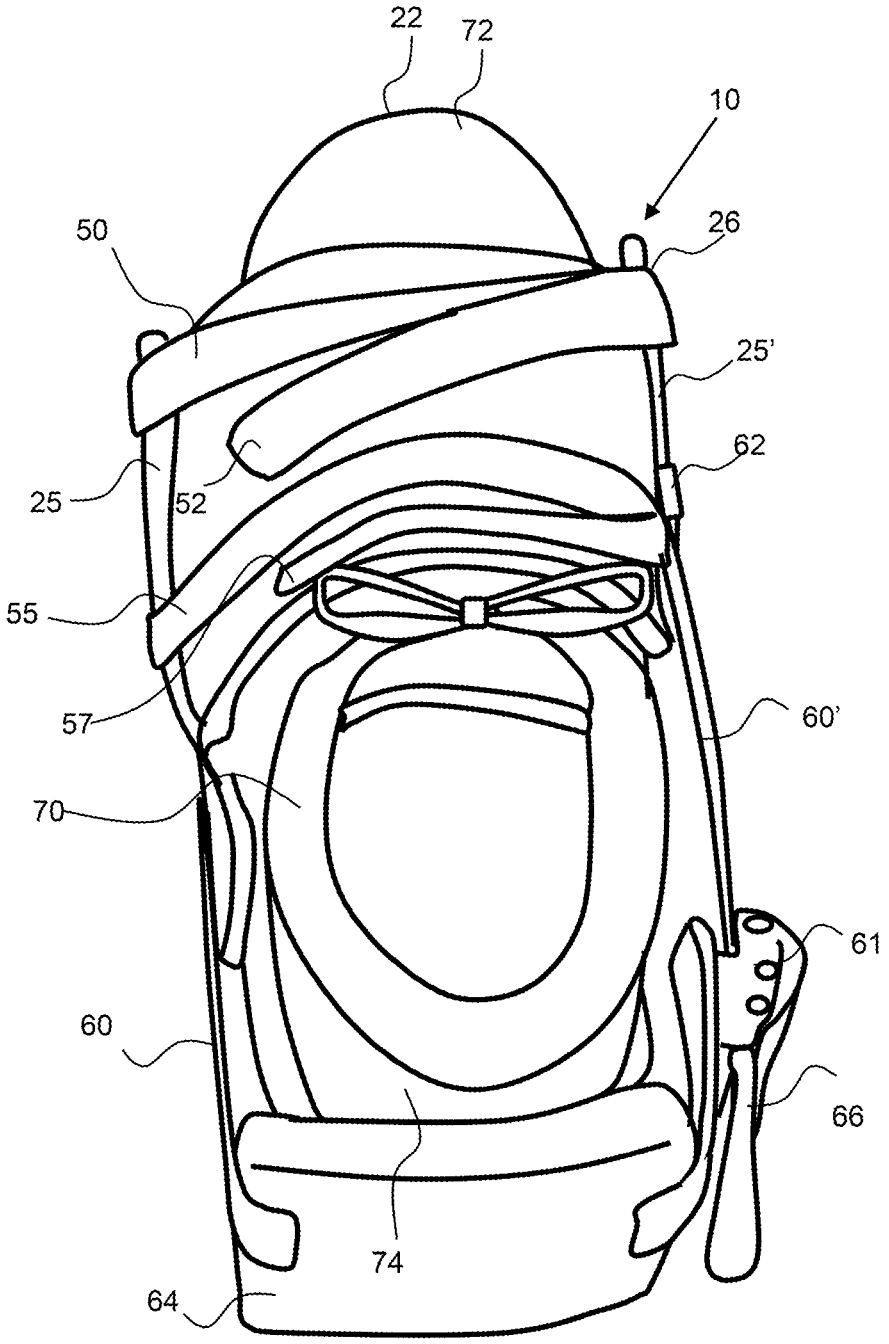
FIG. 9 shows a top view of an exemplary roofing shoe traction chassis system having a shoe coupled thereto by the toe and foot straps and the heel strap. The toe of the shoe 72 is coupled to and extends out from the toe strap 50.

Referring now to FIGS. 7 to 9, a foot pad assembly 49 has a toe strap 50 and a foot strap 55 extending from the foot pad portion 54 the foot pad assembly. The foot pad has hook-and-loop fastener 59 to allow the loose end hook and loop fasteners 53, 58 of the toe and foot strap, respectively, to fasten directly to the foot pad hook-and-loop fastener 59. Note that one end of both the toe and foot strap may be pre-attached to the foot pad thereby allowing a user to slip their shoe under the foot pad and simply pull the remaining loose end of the toe strap 52 and loose end of the foot strap 57 tight and attach to the foot pad by the toe strap loose end hook and loop fastener 53 and foot strap loose end hook and loop fastener 58.

As shown in FIG. 8, the heel strap has a first heel strap portion 60 engage with the second heel strap portion 60', which has ratchet teeth 66 retained by the ratchet 61.

As shown in FIG. 9, a shoe 70 is retained in a roofing shoe traction chassis 20 by the toe strap 50, the foot strap 55 and the heel strap 60. The heel pad 64 is secured around the heel of the shoe 74 by the heel strap 60 retained by the heel strap post 62.

Figure 10:
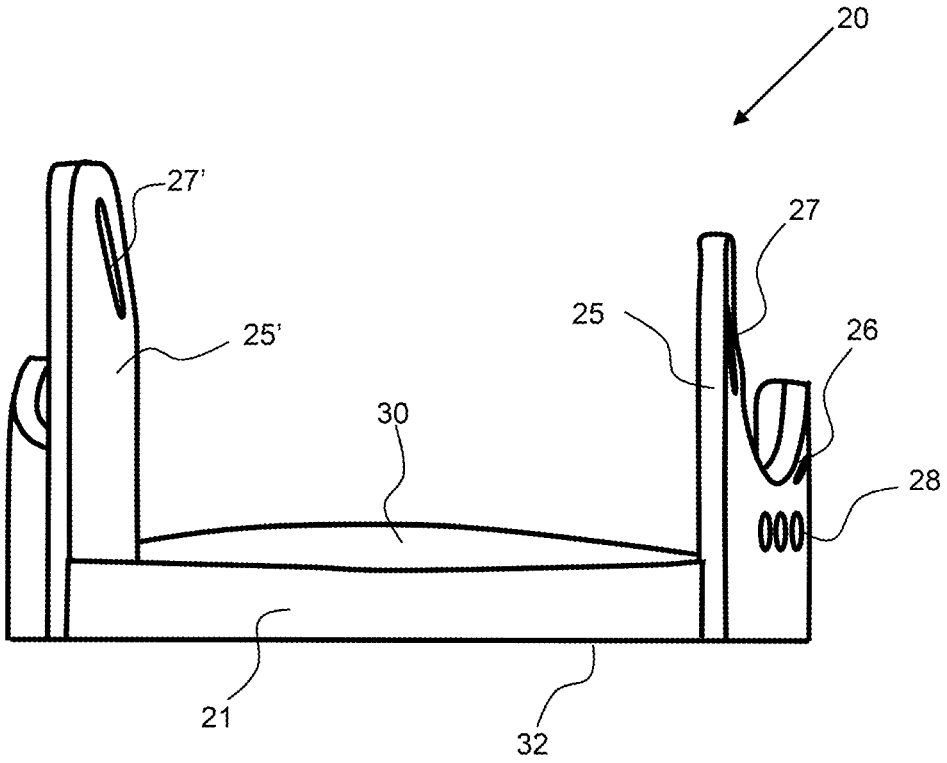
FIG. 10 shows a heel end view of an exemplary roofing shoe traction chassis having a sole surface on the top, a traction surface on the bottom and strap supports extending up from the support plate on the inside and outside of the roofing shoe traction chassis.

As shown in FIG. 10 an exemplary roofing shoe traction chassis 20 has a sole surface 30 and both an inside strap support 25 and outside strap support 25' extending up from the support plate 21 on the inside and outside of the roofing shoe traction chassis. The support plate has both the toe strap aperture 26 and foot strap aperture 27 configured therein to receive the toe and heel strap, respectively.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A roofing shoe traction chassis system comprising:

a) a roofing shoe traction chassis comprising:

i) a support plate comprising:

a length from a toe end to a heel end;

a sole surface for receiving a shoe thereon;

a traction surface opposite the sole surface and having a base hook-and-loop fastener ii) a strap support extending up from the support plate;

b) a toe strap secured to the strap support and configured to extend over a toe of said shoe;

c) a foot strap secured to the strap support and configured to extend over the shoe to secure said shoe to the roofing shoe traction chassis;

d) a heel strap secured to the strap support and extending around a heel of said shoe;

e) a detachable traction sheet comprising:

i) a hook-and-loop fastener layer for detachable attachment to the base hook-and-loop fastener;

ii) a traction layer to provide good traction with a roof surface;

wherein the roofing shoe traction chassis is configured for detachable attachment to a shoe f) a foot pad;

wherein the toe strap and foot strap are coupled to the foot pad.

2. The roofing shoe traction chassis system of claim 1, wherein the toe strap comprises:

a strap hook-and-loop fastener configured over a portion of the toe strap; and a loose-end hook-and-loop fastener configured on a loose end of the toe strap and configured for detachable attachment to the strap hook-and-loop fastener.

3. The roofing shoe traction chassis system of claim 1, wherein the foot strap comprises:

a strap hook-and-loop fastener configured over a portion of the foot strap; and a loose-end hook-and-loop fastener configured on a loose end of the toe strap and configured for detachable attachment to the strap hook-and-loop fastener.

4. The roofing shoe traction chassis system of claim 1, wherein the strap support comprises an inside strap support and an outside strap support that extend up from the support plate and wherein the toe strap and the foot straps extend therebetween.

5. The roofing shoe traction chassis system of claim 1, wherein the foot pad comprises a hook-and-loop fastener and wherein a loose end of each of the toe strap and foot strap comprise a strap hook-and-loop fastener that is configured to detachably attach to the foot pad hook-and-loop fastener.

6. The roofing shoe traction chassis system of claim 5, wherein the heel strap comprises a heel strap post and wherein the strap support comprises a plurality of heel post apertures for receiving said heel strap post to secure the heel strap to the strap support.

7. The roofing shoe traction chassis system of claim 6, wherein the plurality of heel strap post apertures are configured consecutively along the length of the support plate.

8. The roofing shoe traction chassis system of claim 6, wherein the strap support comprises an inside strap support and an outside strap support that extend up from the support plate and wherein the toe strap and the heel strap extend between the inside and outside strap supports.

9. A method of donning a roofing shoe comprising:

providing a roofing shoe traction chassis system comprising:

a) a roofing shoe traction chassis comprising:

i) a support plate comprising:

a length from a toe end to a heel end;

a sole surface for receiving a shoe thereon;

a traction surface opposite the sole surface and having a base hook-and-loop fastener ii) a strap support extending up from the support plate;

b) a toe strap secured to the strap support and configured to extend over a toe of said shoe;

c) a foot strap secured to the strap support and configured to extend over the shoe to secure said shoe to the roofing shoe traction chassis;

d) a heel strap coupled secured to the strap support and extending around a heel of said shoe;

e) a detachable traction sheet comprising:

i) a hook-and-loop fastener layer for detachable attachment to the base hook-and-loop fastener;

ii) a traction layer to provide good traction with a roof surface;

f) a foot pad;

wherein the roofing shoe traction chassis is configured for detachable attachment to a shoe;

placing a foot into the roofing shoe traction chassis on top of the support plate;

securing said toe strap to the foot pad to secure a toe of said shoe to the roofing shoe traction chassis;

securing said foot strap to the foot pad to secure said shoe to the roofing shoe traction chassis;

extending the heel strap around a heel of said foot and securing to strap support to secure the heel of said foot to the roofing shoe traction chassis wherein the toe strap and foot strap are coupled to the foot pad.

10. The method of claim 9, wherein the toe strap comprises:

a strap hook-and-loop fastener configured over a portion of the toe strap; and a loose-end hook-and-loop fastener configured on a loose end of the toe strap and configured for detachable attachment to the strap hook-and-loop fastener.

11. The method of claim 9, wherein the foot strap comprises:

a strap hook-and-loop fastener configured over a portion of the foot strap; and a loose-end hook-and-loop fastener configured on a loose end of the toe strap and configured for detachable attachment to the strap hook-and-loop fastener.

12. The method of claim 9, wherein the strap support comprises an inside strap support and an outside strap support that extend up from the support plate and wherein the toe strap and the foot straps extend therebetween.

13. The method of claim 9, wherein the foot pad comprises a hook-and-loop fastener and wherein a loose end of each of the toe and foot straps comprises a strap hook-and-loop fastener that is configured to detachably attach to the foot pad hook-and-loop fastener.

14. The method of claim 13, wherein the toe strap and foot strap are each attached to the foot pad.

15. The method of claim 14, wherein the toe strap and foot strap each extend through an aperture in the foot pad.

16. The method of claim 9, wherein the strap support comprises a plurality of heel strap post apertures, and wherein the heel strap comprises a heel strap post that is configured for detachable attachment to one of said plurality of heel strap post apertures on the strap support.

17. The method of claim 16, wherein the plurality of heel strap post apertures are configured consecutively along the length of the support plate.

18. The method of claim 17, wherein the strap support comprises an inside strap support and an outside strap support that extend up from the support plate and wherein the heel strap extends therebetween.

19. The method of claim 9, wherein the heel strap further comprises a ratchet and a plurality of ratchet teeth configured to tighten the heel strap around a heel of a shoe.

20. The method of claim 9, wherein the toe strap comprises a toe strap hook-and-loop fastener configured over a portion of the toe strap and a loose-end hook-and-loop fastener configured on a loose end of the toe strap and configured for detachable attachment to the toe strap hook-and-loop fastener;

wherein the foot strap comprises a foot strap hook-and-loop fastener configured over a portion of the foot strap, and a loose-end hook-and-loop fastener configured on a loose end of the foot strap and configured for detachable attachment to the foot strap hook-and-loop fastener;

wherein the strap support comprises a plurality of heel strap post apertures, and wherein the heel strap comprises a heel strap post that is configured for detachable attachment to one of said plurality of heel strap post apertures on the strap support;

wherein the strap support comprises an inside strap support and an outside strap support that extend up from the support plate and wherein the toe strap and the heel strap extend between the inside and outside strap supports.

* * * * *